US006447311B1

(12) United States Patent
Hu et al.

(10) Patent No.: US 6,447,311 B1
(45) Date of Patent: Sep. 10, 2002

(54) ELECTRICAL CONNECTOR WITH GROUNDING MEANS

(75) Inventors: Jinkui Hu; ZiQiang Zhu, both of Kunsan (CN)

(73) Assignee: Hon Hai Precision Ind, Co., Ltd., Taipei Hsien (TW)

( * ) Notice: Subject to any disclaimer, the term of this patent is extended or adjusted under 35 U.S.C. 154(b) by 0 days.

(21) Appl. No.: 10/041,078

(22) Filed: Dec. 28, 2001

(51) Int. Cl.[7] ..... H01R 13/648
(52) U.S. Cl. ..... 439/108; 439/607
(58) Field of Search ..... 439/108, 607–610, 439/101, 95

(56) References Cited

U.S. PATENT DOCUMENTS 5,562,496 A * 10/1996 Benjamin et al. ..... 439/607
5,599,207 A * 2/1997 Lai ..... 439/567
5,637,014 A * 6/1997 Sukegawa et al. ..... 439/607
5,697,799 A * 12/1997 Consoli et al. ..... 439/181
5,727,970 A * 3/1998 Koguchi et al. ..... 439/607
6,077,115 A * 6/2000 Yang et al. ..... 439/567
6,155,878 A * 12/2000 Chen ..... 439/607
6,190,205 B1 * 2/2001 Wu ..... 439/607
6,206,730 B1 * 3/2001 Avery et al. ..... 439/609
6,280,209 B1 * 8/2001 Bassler et al. ..... 439/101
6,287,146 B1 * 9/2001 Avery et al. ..... 439/607
6,299,487 B1 * 10/2001 Lopata et al. ..... 439/610
6,315,608 B1 * 11/2001 Lopata et al. ..... 439/607
6,343,951 B1 * 2/2002 Ono et al. ..... 439/571
6,347,961 B2 * 2/2002 Zhu et al. ..... 439/607
6,354,875 B1 * 3/2002 Wu ..... 439/607

* cited by examiner

*Primary Examiner*—P. Austin Bradley
*Assistant Examiner*—Ross Gushi
(74) *Attorney, Agent, or Firm*—Wei Te Chung

(57) ABSTRACT

An electrical connector (1) comprises an insulative housing (2) having a base portion (20) and a pair of support walls (21, 22) projecting from a front face (200) of the base portion (20), a plurality of terminals (3) retained in the housing, a shell (4) enclosing the support walls of the housing, and a grounding tab (5) for contacting with the shell. The shell comprises a rearwardly extending projection (46). The projection has a cutout (462) at a free end thereof and a lug (464) located below the cutout. The grounding tab includes a body portion (50) securely retained in the base portion, a solder portion (52) for electrical connection with a grounding trace of a circuit board, and an abutment (542) abutting against the lug of the shell.

12 Claims, 7 Drawing Sheets

ELECTRICAL CONNECTOR WITH GROUNDING MEANS

BACKGROUND OF THE INVENTION

1. Field of the Invention

The present invention relates to an electrical connector having grounding means, and more particularly to an IEEE (Institute of Electrical and Electronics Engineers) 1394b electrical connector having grounding means for eliminating interference caused by static electricity, thereby ensuring reliable signal transmission between the connector and a complementary connector.

2. Description of Related Art

IEEE 1394b connectors are commonly used to connect external and internal peripheral devices to a computer for performing high speed data transmission therebetween. These connectors typically employ a plug connector terminated to a transmission cable and a receptacle connector mounted on a circuit board of the computer. The receptacle connector comprises an insulative housing having a base portion and a mating portion, a plurality of conductive terminals retained in the housing, an inner metal shell enclosing the mating portion of the housing for electromagnetic interference protection, and an outer metal shield enclosing both the housing and the inner shell for further electromagnetic interference protection. During the signal transmission process, static electricity accumulates on the insulative housing. In order to discharge the static electricity, the inner shell and the outer shield should be connected to grounding traces of the circuit board for grounding. The outer shield can be conveniently connected to the grounding traces of the circuit board via grounding tabs integrally extending from sidewalls thereof.

However, because the inner shell is received in the outer shield and is partly embedded in the insulative housing, it is difficult to connect the inner shell to the grounding traces of the circuit board. An existing inner shell has been designed to have integral grounding tabs for electrical connection with the grounding traces of the circuit board. However, each grounding tab is connected with the inner shell via a narrow connecting portion therebetween which has a weak mechanical strength. When a mating plug connector is inserted into or pulled out from the receptacle connector, inappropriate inserting and pulling forces may cause the connecting portion to break, whereby the grounding tab is ineffective. Furthermore, assembly of the integrally formed inner shell to the insulative housing becomes difficult.

Hence, a receptacle connector with improved inner shell grounding means is desired to overcome the disadvantages of the related art. The copending application titled "RECEPTACLE CONNECTOR WITH GROUNDING TABS" with an unknown serial number, the same applicants and the same assignee, filed on Dec. 27, 2001, discloses some approach of implementation.

SUMMARY OF THE INVENTION

Accordingly, a first object of the present invention is to provide a receptacle connector having inner shell grounding means for eliminating static electricity, thereby ensuring reliable signal transmission between the connector and a complementary connector.

A second object of the present invention is to provide a receptacle connector having individually made inner shell and grounding tabs, the grounding tabs being capable of conveniently and reliably connecting the inner shell to grounding traces of a circuit board on which the receptacle connector is mounted.

In order to achieve the objects set forth, an electrical connector in accordance with the present invention comprises an insulative housing having a base portion and a pair of support walls projecting from a front face of the base portion, a plurality of terminals received in the housing, a shell enclosing the support walls of the housing, and a grounding tab securely retained in the housing. A plurality of passageways are defined through the support walls and the base portion for receiving the terminals. The terminals include mating portions disposed along the support walls for engaging with corresponding terminals of a complementary plug connector, and tail portions for being soldered to a circuit board on which the connector is mounted. The shell comprises a projection rearwardly extending from a sidewall thereof. The projection has a cutout at a free end thereof and a lug located below the cutout. The grounding tab includes a body portion securely received in the base portion, a solder portion extending in a direction perpendicularly to the body portion for electrical connection with a grounding trace of the circuit board, and a spring arm integrally punched from the body portion. The spring arm has an abutment abutting against the lug of the shell. Thus, a reliable grounding path is established between the shell and the circuit board.

Other objects, advantages and novel features of the invention will become more apparent from the following detailed description when taken in conjunction with the accompanying drawings.

DETAILED DESCRIPTION OF THE INVENTION

Figure 1:
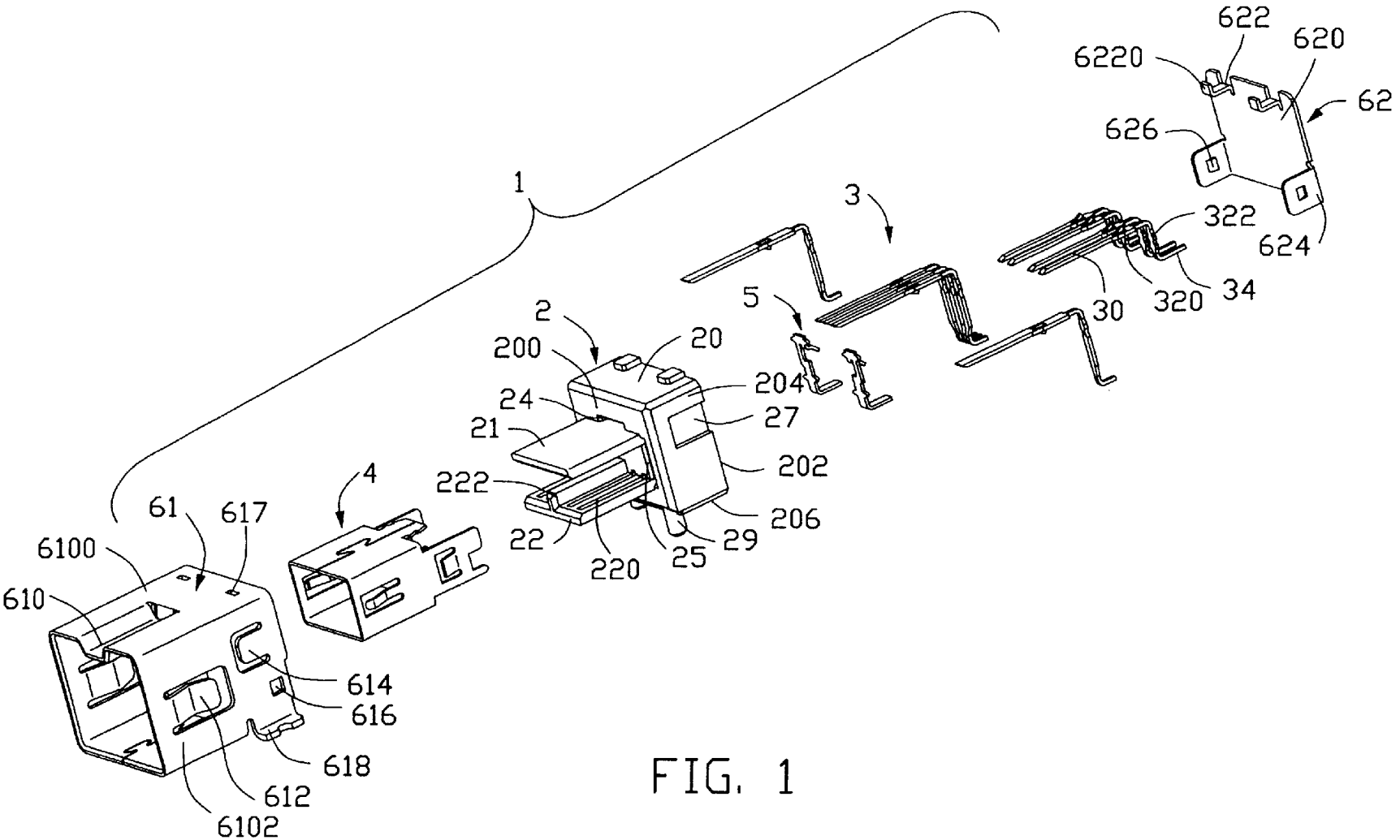
FIG. 1 is an exploded, perspective view of a receptacle connector having grounding tabs in accordance with the present invention.
Figure 4:
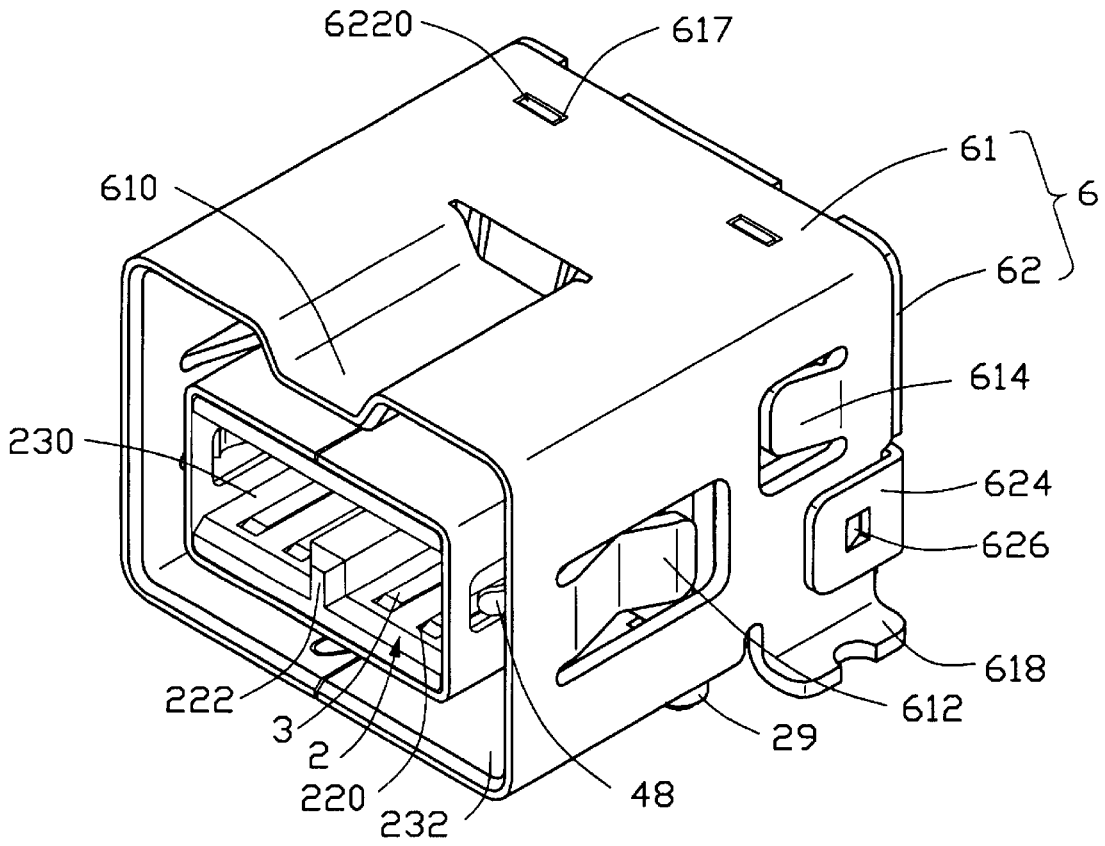
FIG. 4 is an assembled, perspective view of the connector in FIG. 1.
Figure 5:
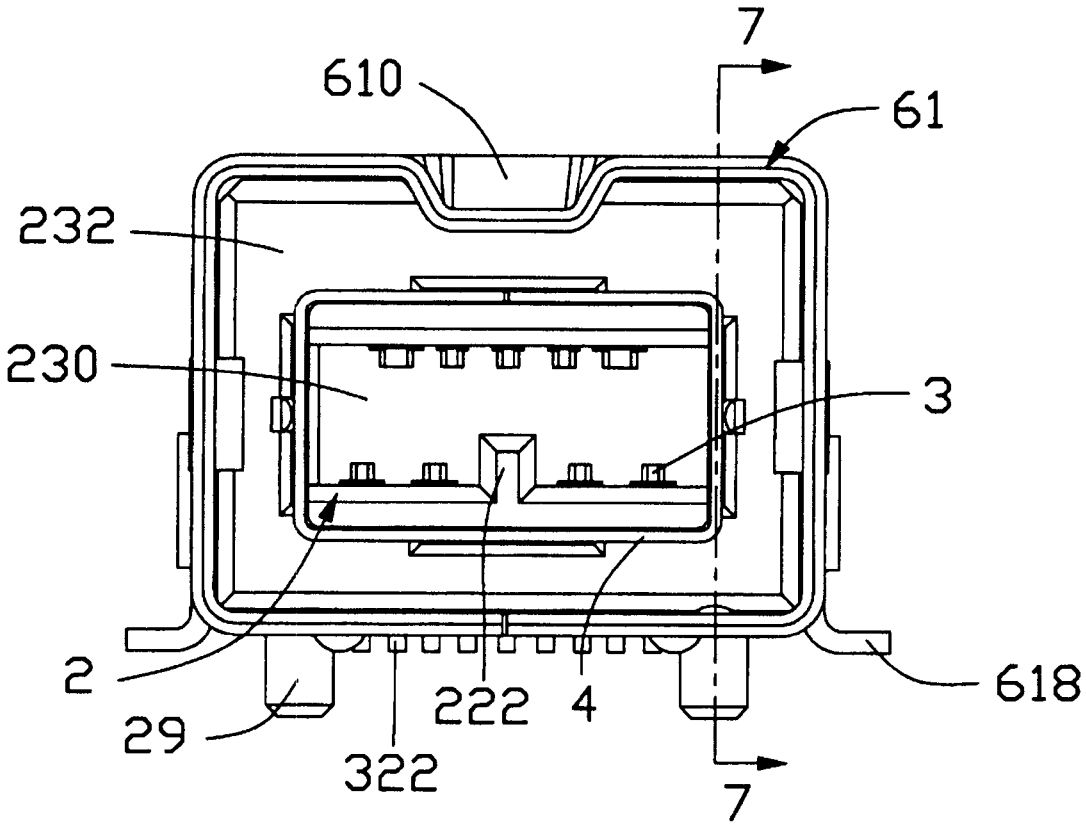
FIG. 5 is a front, plan view of the connector in FIG. 4.

Referring to FIGS. 1 and 4, and IEEE 1394b connector 1 in accordance with the present invention comprises an insulative housing 2 having a base portion 20 and a pair of support walls 21, 22 projecting from a front face 200 of the base portion 20 in a cantilevered manner, a plurality of conductive terminals 3 for being retained in the housing 2, an inner shell 4 for enclosing the support walls 21, 22 of the housing 2, a pair of grounding tabs 5 for being connected to the inner shell 4, and an outer shield 6 for enclosing both the inner shell 4 and the insulative housing 2.

Figure 6:
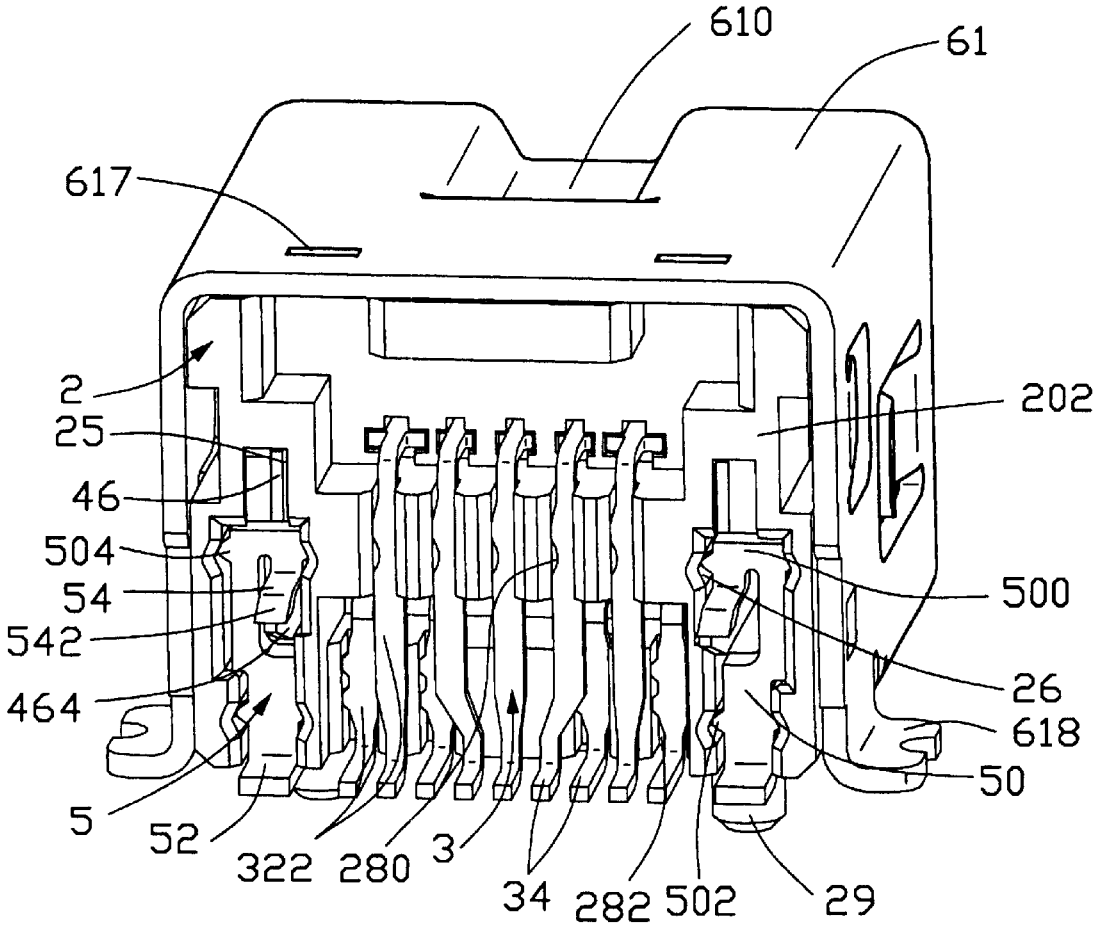
FIG. 6 is a rear, perspective view of the connector in FIG. 4 prior to assembly of a rear shielding cover thereof.
Figure 7:
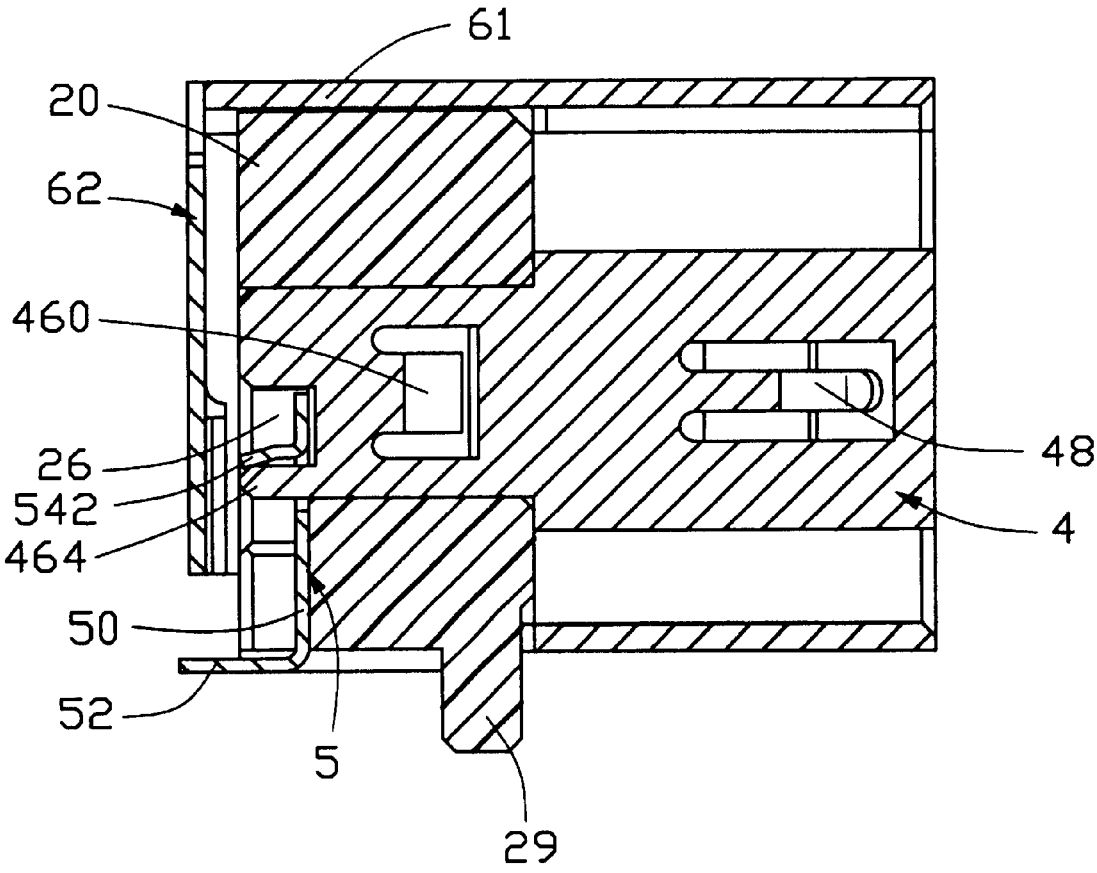
FIG. 7 is a cross-sectional view of the connector taken along section line 7—7 in FIG. 5.

The support walls 21, 22 of the insulative housing 2 define a plurality of terminal-receiving passageways 220 extending through the base portion 20. The base portion 20 defines a pair of horizontal slots 24 and a pair of vertical slits 25 through the front face 200 thereof, and a pair of recesses 26 (shown in FIG. 6) communicating with the slits 25 in a rear face 202 of the base portion 20. The base portion 20 further defines a pair of depressions 27 in opposite side faces 204 thereof, and a plurality of upper and lower retaining channels 280, 282 (shown in FIG. 6) in the rear face 202. A pair of positioning pins 29 downwardly extends from a mounting face 206 of the base portion 20 for being received within corresponding positioning holes defined in a circuit board (not shown) on which the connector 1 is mounted. For polarization and alignment purposes, the support walls 22 is formed with a central key 222 for being received within a corresponding keyway defined in a complementary plug connector (not shown).

The conductive terminals 3 are received in the passageways 220 of the insulative housing 2. The conductive terminals 3 include signal terminals, ground terminals and other terminals for carrying power as well as for other desired purposes. The conductive terminals 3 have mating portions 30 disposed along the support walls 21, 22 of the housing 2 for engaging with corresponding terminals of the complementary plug connector, horizontal retention portions 320 embedded in the base portion 20 of the housing 2, vertical retention portions 322 secured in the upper and the lower retaining channels 280, 282 of the housing 2, and tail portions 34 for being soldered to the circuit board.

Figure 2:
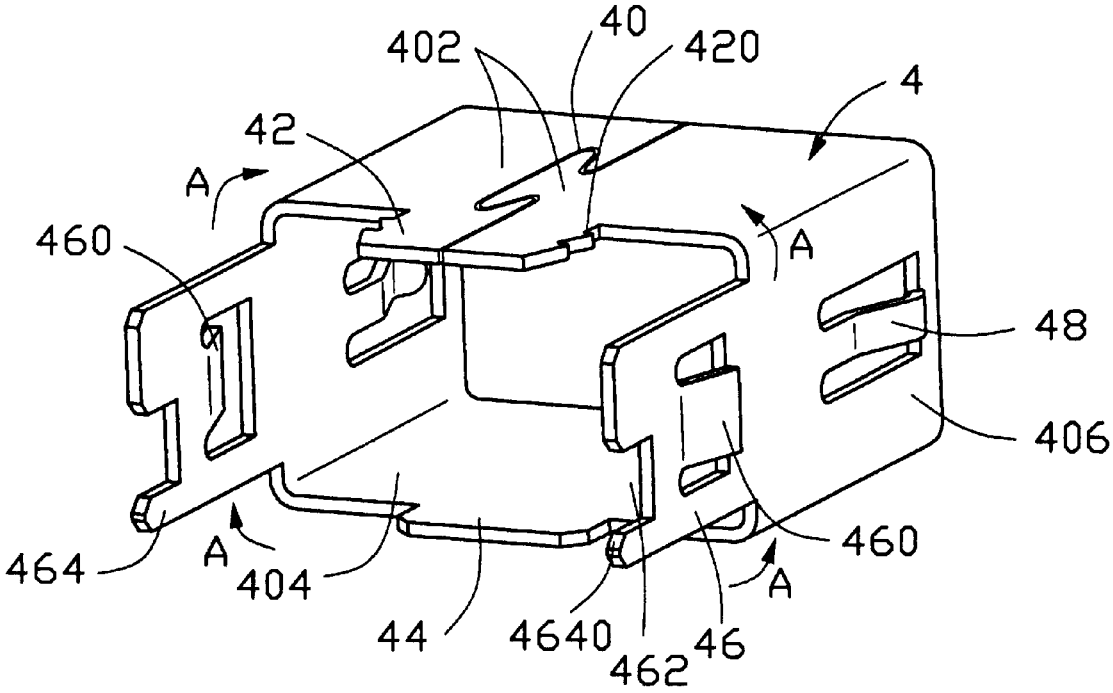
FIG. 2 is an enlarged, perspective view of an inner shell of the connector in FIG. 1.

Referring to FIG. 2, the inner shell 4 is obtained from a stamped single metal piece having a pair of end portions 402. Each end portion 402 includes a rearwardly extending extension 42 having a plurality of barbs 420. This metal piece is folded around itself in directions indicated by arrows "A" until the end portions 402 are joined with a seam 40 left therebetween to shape the inner shell 4 in a rectangular box-like form. The inner shell 4 has a tongue 44 formed on a bottom wall 40 in alignment with the extensions 42. A pair of projections 46 rearwardly extends from opposite sidewalls 406 of the inner shell 4. Each projection 46 has a forwardly and outwardly extending tab 460 integrally punched therefrom, a cutout 462 defined in a free end thereof, and a lug 464 located below the cutout 462. The lug 464 has an inclined face 4640 at a free end thereof. The sidewalls 406 have a pair of forwardly and outwardly extending spring fingers 48 integrally punched therefrom for contacting with a corresponding shell of the plug connector.

Figure 3:
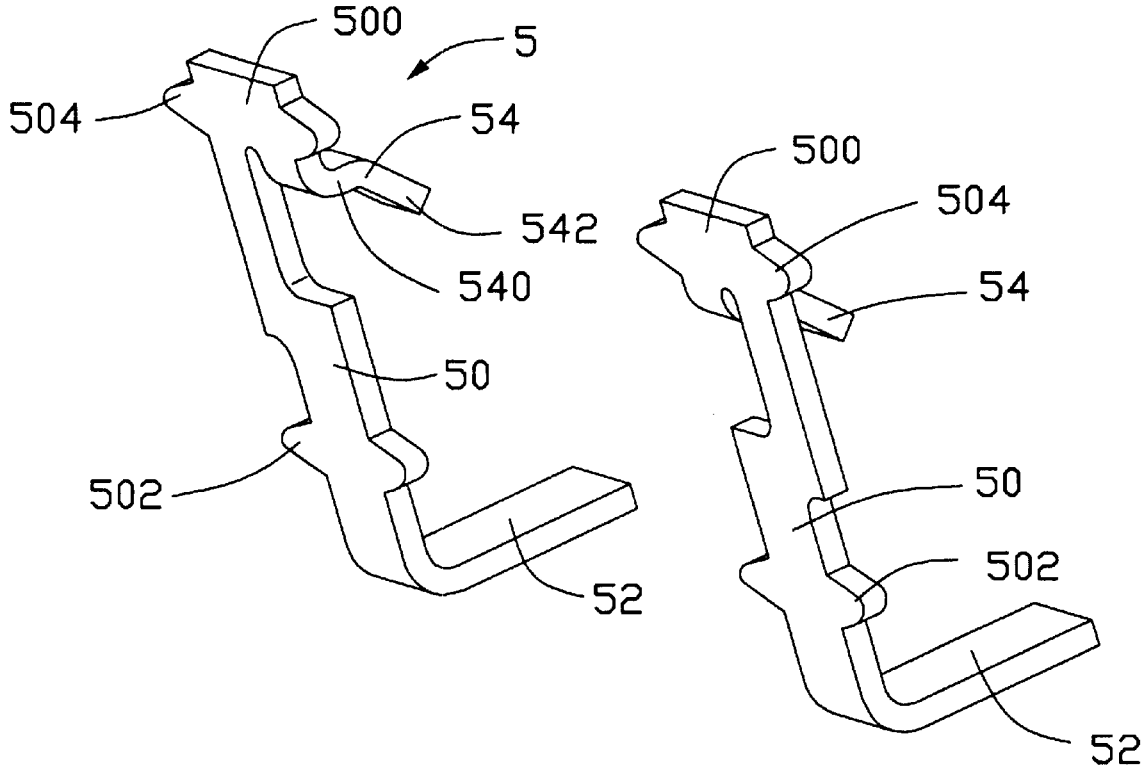
FIG. 3 is an enlarged, perspective view of the grounding tabs of the connector in FIG. 1.

Referring to FIG. 3, each of the grounding tabs 5 is stamped from a single metal blank to be generally of an L-shaped configuration and includes a body portion 50, a solder portion 52 perpendicularly extending from a lower end of the body portion 50 for electrical connection with grounding traces of the circuit board, and a rearwardly and downwardly extending spring arm 54 integrally punched from the body portion 50. The spring arm 54 is located adjacent to an upper end 500 of the body portion 50 and has a curved section 540 connecting with the body portion 50 and an abutment 542 rearwardly and downwardly extending from the curved section 540 for abutting against the inclined face 4640 of a corresponding lug 464 of the inner shell 4. The body portion 50 has two pairs of knobs 502, 504 projecting from opposite sides thereof and respectively disposed adjacent to the solder portion 52 and the spring arm 54.

Referring back to FIG. 1, the outer shield 6 includes a shielding case 61 and a rear shielding cover 62. The case 61 has a depressed portion 610 formed in its top wall 6100 for engaging with a like-formed recess of the complementary plug connector, a pair of rearwardly and inwardly extending contact arms 612 integrally stamped from opposite sidewalls 6102 thereof for engaging with corresponding recesses defined in the plug connector, and a pair of forwardly and inwardly extending tongues 614 integrally stamped from the sidewalls 6102 for engaging with the depressions 27 of the housing 2. The case 61 further defines a pair of apertures 616 in the sidewalls 6102 and a pair of holes 617 in the top wall 6100. A pair of tabs 618 integrally extends from the respective sidewalls 6102 of the case 61 and bent outwardly for electrical connection with the grounding traces of the circuit board.

The rear shielding cover 62 includes a rear plate 620, a pair of fingers 622 adjacent to a top edge of the rear plate 620, and a pair of locking sections 624 with tangs 626 integrally punched therefrom extending forwardly from side edges of the rear plate 620. The fingers 622 have upwardly extending portions 6220 for being received in the holes 617 of the case 61.

Referring to FIGS. 4–7 in conjunction with FIGS. 1–3, in assembly, the inner shell 4 encloses the support walls 21, 22 of the housing 2 to define a receiving cavity 230 therein. The extensions 42 and the tongue 44 of the inner shell 4 are inserted in the slots 24 of the housing 2 for securely attaching the inner shell 4 to the housing 2. At the same time, the extensions 42 are closely abutting each other with no seam left therebetween. The projections 46 of the inner shell 4 are received and retained in the slits 25 of the housing 2 via a spring engagement between the tabs 460 and the slits 25. The lugs 464 of the projections 46 extend into the recesses 26 of the housing 2.

The pair of grounding tabs 5 are then placed into the recesses 26 of the housing 2 from the rear face 202. The knobs 502, 504 of the grounding tabs 5 are interference fitting with the recesses 26, thereby securely retaining the body portions 50 of the grounding tabs 5 in the recesses 26. The upper ends 500 of the body portions 50 are engaged with the cutouts 462 of the inner shell 4. The abutments. 542 of the spring arms 54 abut against the inclined faces 4640 of the lugs 464 of the inner shell 4. Therefore, once the solder portions 52 of the grounding tabs 5 are soldered to the grounding traces of the circuit board, a grounding path is established between the inner shell 4 and the circuit board via the grounding tabs 5.

The outer shield 6 finally encloses both the housing 2 and the inner shell 4. The shielding case 61 is assembled to the housing 2 via an interferential engagement between the tongues 614 and the depressions 27 in the side faces 204 of the housing 2. The rear shielding cover 62 is secured to the housing 2 along the rear face 202. The upwardly extending portions 6220 of the fingers 622 of the rear cover 62 are retained in the holes 617 of the case 61. The locking sections 624 of the cover 62 extend along the sidewalls 6102 of the case 61 and the tangs 626 are seated in the apertures 616 of the case 61. Thus, the outer shield 6 securely encloses the housing 2. It can be seen that the outer shield 6 and the inner shell 4 define a generally annular cavity 232 therebetween for receiving a corresponding part of the complementary connector.

A feature of the present invention is that the inner shell 4 and the grounding tabs 5 are individually made. The grounding tabs 5 are conveniently assembled to the insulative housing 2 and reliably abut against the inner shell 4. When the solder portions 52 of the grounding tabs 5 are soldered to the grounding traces of the circuit board, a reliable grounding path is established between the inner shell 4 and the circuit board. Furthermore, if the grounding tab 5 is fatigued, a new one can replace it and the inner shell 4 can be reused, thereby decreasing the production cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector mounted on a circuit board for mating with a complementary plug connector, comprising:

an insulative housing having a base portion and a pair of support walls projecting from a front face of the base portion, the base portion defining a slit through the front face and a recess in a rear face thereof communicating with the slit;

a plurality of terminals retained in the housing;

a metal shell enclosing the support walls of the housing and comprising a rearwardly extending projection substantially received in the slit, the projection having a lug at a rear end thereof; and a grounding tab including a body portion securely retained in the recess of the base portion, a solder portion extending from a lower end of the body portion for electrical connection with a grounding trace of a circuit board, and a spring arm obliquely extending from an upper end of the body portion and engaged with the lug of the shell.

2. The receptacle connector as claimed in claim 1, wherein the grounding tab is generally of an L-shaped configuration and the spring arm comprises a curved section connected with the body portion and an abutment downwardly and rearwardly extending from the curved section for engaging with the lug of the shell.

3. The receptacle connector as claimed in claim 1, wherein the lug of the projection extends into the recess of the base portion for engaging with the spring arm of the grounding tab.

4. The receptacle connector as claimed in claim 1, wherein the projection of the shell defines a cutout in a rear end, the lug being located below the cutout, and the upper end of the body portion of the grounding tab is engaged with the cutout of the projection.

5. The receptacle connector as claimed in claim 1, wherein the body portion of the grounding tab has a plurality of knobs projecting from opposite sides thereof for interference fitting with the recess of the base portion of the housing.

6. The receptacle connector as claimed in claim 1, wherein the projection has a forwardly and outwardly extending tab integrally punched therefrom for interferential engagement with the slit.

7. The receptacle connector as claimed in claim 1, wherein the shell has a pair of end portions, each end portion including a rearwardly extending extension having a plurality of barbs, and wherein the base portion of the housing defines a slot through the front face, the extensions of the shell being inserted in the slot and closely abutting each other.

8. The receptacle connector as claimed in claim 1, wherein one of the support walls is formed with a key for being received within a corresponding keyway defined in a complementary plug connector.

9. The receptacle connector as claimed in claim 1, wherein the terminals include mating portions disposed along the support walls of the housing for engaging with corresponding terminals of a complementary connector, retention portions rearwardly extending from the mating portions, and tail portions extending beyond the base portion for electrical connection with the circuit board.

10. The receptacle connector as claimed in claim 9, wherein the base portion defines a plurality of upper and lower retaining channels in the rear face, and wherein the retention portions of the terminals have horizontal retention portions secured in the base portion and vertical retention portions secured in the upper and the lower retaining channels.

11. The receptacle connector as claimed in claim 1, further comprising a shielding case enclosing both the shell and the housing and a rear shielding cover secured to the shielding case for covering the rear face of the body portion.

12. An connector comprising:

an insulative housing defining a recess on a rear face thereof;

a plurality of contacts received in the housing an inner metal shell enclosing said contacts, said inner shell defining a cutout with a lug thereabouts;

an outer metal shell enclosing said inner shell; and a grounding tab positioned between said inner shell and said outer shell, and including a body portion securely received in the recess, and an end with a spring arm received in said cutout; wherein said spring arm abuts against said lug.

* * * * *